US005611417A

United States Patent [19]

Stawniak et al.

[11] Patent Number: 5,611,417

[45] Date of Patent: Mar. 18, 1997

[54] APPARATUS FOR STOPPING A PASSENGER CONVEYOR

[75] Inventors: Andrzej Stawniak, Brünnerstr; Robert Ulrich, Bruckneudorf, both of Austria

[73] Assignee: Inventio AG, Hergiswil NW, Switzerland

[21] Appl. No.: 633,424

[22] Filed: Apr. 17, 1996

[30] Foreign Application Priority Data

Apr. 24, 1995 [CH] Switzerland ..... 01162/95

[51] Int. Cl.[6] ..... B66B 29/06

[52] U.S. Cl. ..... 198/323; 198/325

[58] Field of Search ..... 198/322, 323, 198/325

[56] References Cited

U.S. PATENT DOCUMENTS

| | | | |
|---|---|---|---|
| 2,109,210 | 2/1938 | Dunlop | 198/323 |
| 2,862,599 | 12/1958 | Sinden et al. | 198/323 |
| 4,088,219 | 5/1978 | Binns | 198/323 |
| 4,800,998 | 1/1989 | Myrick | 198/323 |
| 5,255,771 | 10/1993 | Nurnberg et al. | 198/323 |
| 5,307,918 | 5/1994 | Rivera et al. | 198/323 |
| 5,390,800 | 3/1995 | Hofling et al. . | |

FOREIGN PATENT DOCUMENTS

| | | | |
|---|---|---|---|
| 0523832 | 1/1993 | European Pat. Off. . | |
| 2427286 | 12/1979 | France . | |
| 1159589 | 7/1969 | United Kingdom | 198/323 |

*Primary Examiner*—D. Glenn Dayoan
*Attorney, Agent, or Firm*—Howard & Howard

[57] ABSTRACT

An apparatus for stopping passenger conveyors, such as escalators and moving walkways having at least one comb plate, responds to movement of the comb plate due to an applied force to actuate a safety switch. The apparatus exerts a static trigger force on the comb plate which trigger force has horizontal and vertical components. The comb plate is movable horizontally and vertically against a static trigger force when the applied force exceeds one or both of the horizontal and vertical components. The trigger force is set by a biased trigger spring pivotally mounted on a carrier plate for the comb plate and acting at an adjustable angle relative to the horizontal plane permitting selection of the ratio of the horizontal component to the vertical component. The angular position can be reset manually within a certain angular range through engagement of detent notches on an abutment attached to the comb plate and detent pins connected to the trigger spring.

20 Claims, 1 Drawing Sheet

APPARATUS FOR STOPPING A PASSENGER CONVEYOR

BACKGROUND OF THE INVENTION

The present invention relates generally to a passenger conveyor and, in particular, to an apparatus for stopping a passenger conveyor in response to the application of a predetermined force on a comb plate of the passenger conveyor.

United States safety regulations (ASME A17.1/Rule 805.1) require that an escalator or a moving walkway must be stopped by actuating a safety switch when, as a consequence of an obstruction, an horizontal force acting on a comb plate exceeds a value of 500 newtons or a vertical force acting on the comb plate exceeds a value of 668 newtons for each side. This regulation has the consequence that existing safety equipment must be modified and new safety equipment must be constructed in conformity with the regulations.

The U.S. Pat. No. 5,398,800 shows a safety device for actuating a safety switch when a carrier plate of a people mover is displaced in either the horizontal direction or the vertical direction. The safety switch triggering equipment includes an horizontally extending switching rod tensioned by a compression spring and a safety switch. A pivotable angle lever is coupled as an intermediate member between the carrier plate which has comb segments and the switching rod. Upon movement of the carrier plate in an horizontal direction, the triggering of the safety switch takes place since the angle lever accompanies the movement to move the switching rod although the lever is not rotated. Upon a vertical movement of the carrier plate, the angle lever is rotated to move the switching rod. The triggering travels are settable by means of set screws and the triggering force is settable by means of variable spring tension. The ratio of the horizontal to the vertical triggering force is defined solely by the geometric dimensions, the lever arm lengths, of the vertically and horizontally extending arms of the angle lever. In addition to this triggering equipment, the front part of the comb plate is formed to be somewhat movable and can actuate a signal-generating pressure hose in the case of a force applied in the vertical direction.

The invariable fixed ratio of the horizontal to the vertical triggering forces in the above described safety device is restrictive. The indirect transmission of the vertical movement of the carrier plate to the triggering equipment by the angle lever produces additional friction and can, also as a consequence of wear, disadvantageously influence the reproducibility of the triggering forces in both the vertical and the horizontal directions.

SUMMARY OF THE INVENTION

The present invention concerns an apparatus for stopping a people conveyor, the people conveyor having a comb plate for supporting people slidably mounted on a carrier plate for relative movement between the comb plate and the carrier plate in a generally horizontal direction and a generally vertical direction in response to forces applied to the comb plate. The apparatus includes a trigger spring means having means for pivotally mounting on the carrier plate for applying a trigger force to the comb plate, a trigger force magnitude adjusting means connected to the trigger spring means for selectively adjusting a magnitude of the trigger force, an abutment means for attachment to the comb plate, a trigger force component ratio adjustment means coupling the trigger spring means to the abutment means for selectively adjusting a ratio of an horizontal force component to a vertical force component of the trigger force and a switching lever for pivotal mounting on the carrier plate and being connected to the abutment means. When the switching lever is positioned adjacent a safety switch mounted on the carrier plate for controlling movement of the people conveyor and a force is applied to the comb plate which applied force overcomes at least one of the vertical component and the horizontal component of the trigger force, the comb plate moves relative to the carrier plate to rotate the switching lever into actuating contact with the safety switch to actuate the safety switch for stopping the people conveyor.

The trigger spring means includes a spring pin extending through a trigger spring and the means for pivotally mounting includes one end of the spring pin pivotally mounted on an axle pin for attachment to the carrier plate. The trigger force magnitude adjusting means includes an adjusting nut threadably engaging another end of the spring pin and abutting the trigger spring for selectively adjusting a length of the trigger spring. The trigger force component ratio adjustment means includes a plurality of detent notches formed in the abutment means and a detent pin connected to the trigger spring means for selectively releasably engaging the detent notches to change an angle at which the trigger force is applied to the comb plate relative to an horizontal plane.

The switching lever has a switching arm extending from a pivot point of the switching lever to a free end for non-actuating contact with the safety switch and a shorter arm extending from the pivot point to a free end connected to the abutment means. The apparatus includes means for rotating the switching lever out of actuating contact with the safety switch when the applied force is removed from the comb plate. The means for rotating includes an entraining pin having one end pivotally mounted at the free end of the shorter arm of the switching lever and another end extending through an aperture in the abutment means, the entraining pin extending through a compression spring, and an adjusting nut threadably engaging the entraining pin and abutting the compression spring for selectively adjusting a length of the compression spring.

It is an object of the apparatus according to the present invention to provide a safety device for an escalator or a moving walkway, which device does not have the above mentioned disadvantages of the prior art devices and in particular enables an individual determination of the horizontal and vertical components of the trigger force.

The apparatus according to the present invention has as another object a selectively variable ratio of horizontal to vertical components of the trigger force without changing the construction of the apparatus. This object is accomplished by an adjustable positioning of the trigger spring determining the triggering force wherein the selected spring position is releasably secured by a detent pin engaging detent notches.

A further object of the apparatus according to the present invention is the transmission of the trigger force directly from the apparatus to the comb plate and the transmission of the applied force directly from the comb plate to the apparatus.

It is another object of the present invention to use slide pins positioned between the carrier plate and the comb plate as fulcra for actuating a safety switch in response to vertical movement of the comb plate.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
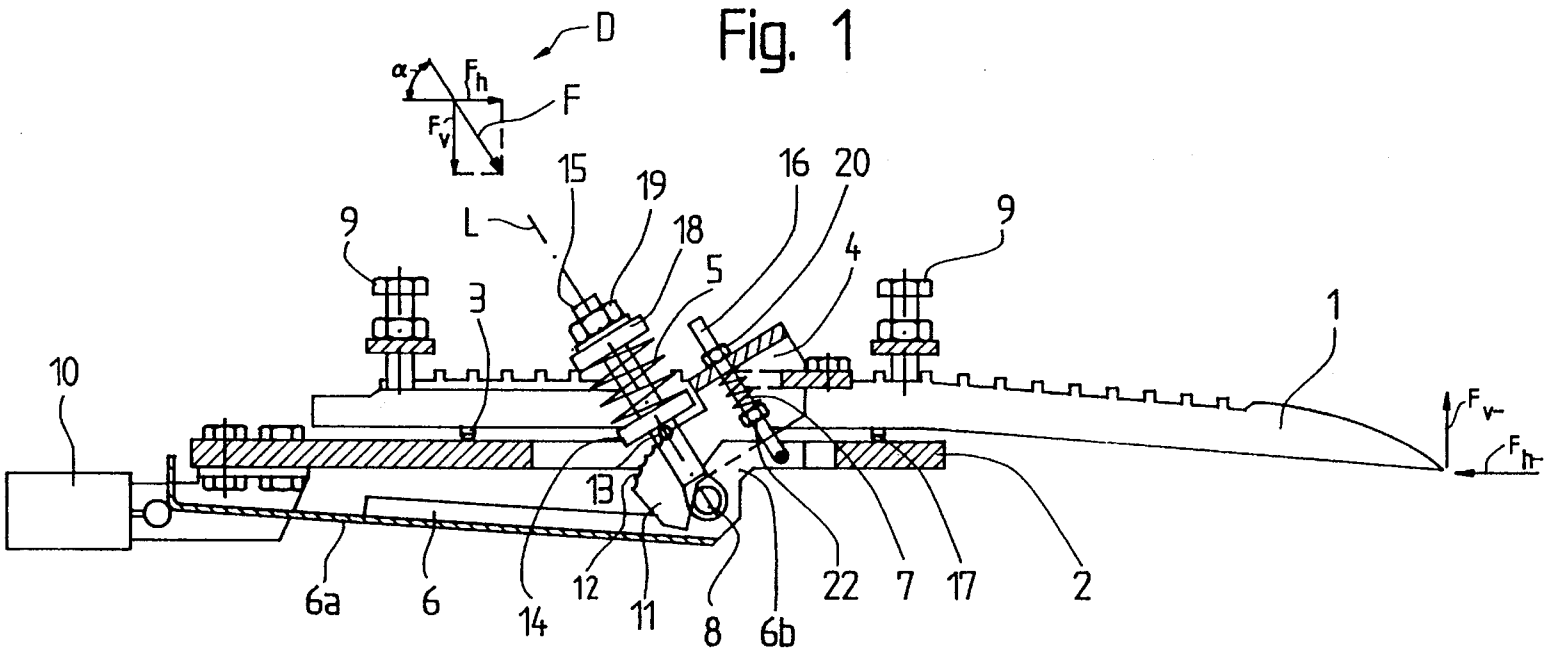
FIG. 1 is a cross-sectional left side elevation view of an apparatus for stopping a people conveyor in accordance with the present invention.

In the FIG. 1, there is shown a comb plate 1 slidably mounted on a carrier plate 2 by front slide pins 17 and rear fulcrum slide pins 3 for relative movement in a generally horizontal direction. An abutment 4, which is firmly attached to the comb plate 1, has a pair of generally parallel and vertically downwardly extending curved legs 11. An upper arcuate edge of each leg 11 has formed thereon a contiguous sequence of approximately half-round detent notches 12 extending over a segment including an angle of about 45°. A spring pin 15 extends between the legs 11 and has a lower end pivotally mounted on an axle pin 8 firmly connected with the carrier plate 2. The spring pin 15 extends through a central opening in a helical first or trigger spring 5, which trigger spring is clamped between an upper pressure washer 18 and a lower pressure washer 14. The washers 14 and 18 are slidably mounted on the pin 15 which extends through central apertures in the washers. The trigger force exerted by the spring 5 can be set by an adjusting nut 19 threadably engaging a threaded upper end of the pin 15 and abutting the upper pressure washer 18 to vary the length of the trigger spring for different triggering forces. The lower pressure washer 14 is constructed as a rim of greater diameter of a sleeve which is displaceable along the spring pin 15. A pair of detent pins 13 mounted on a lower surface of the lower pressure washer 14 extend transverse to a longitudinal axis L of the spring pin 15.

A switching lever 6 is pivotally mounted on the axle pin 8 and has a switching arm **6*a* which extends from the pivot point toward the left to a free end in contact with a safety switch 10 mounted on the carrier plate 2. The end of the switching arm 6*a* is bent upwardly somewhat obliquely to function as a switching cam, and on a downward movement moves into actuating contact with a roller lever of the safety switch 10 to actuate the switch. The safety switch 10 is connected in a safety circuit (not shown) for stopping movement of the people conveyor upon actuation of the safety switch. The switching lever 6 has a relatively shorter arm 6*b* which continues upwardly and towards the right from the axle pin 8. The arm 6*b* is connected at a free end with an oblique surface of the abutment 4 by an entraining pin 16. The entraining pin 16 extends through a helical second or compression spring 7 which is retained between the abutment 4 and an adjusting nut 22 threaded on the pin 16 below the abutment. The compression spring 7 can be compressed to reduce the distance between the arm 6*b* of the switching lever 6 and the abutment 4. The main purpose of the compression spring 7 and the nut 22, however, is to reset or return the switching lever 6 to its initial setting upon relaxation of an external force applied to the comb plate 1**.

Abutment screws 9 are positioned laterally on each side of the comb plate 1 and limit its upward travel upon being raised by a vertically directed force. The longitudinal axis L of the spring pin 15 corresponds with the line of action of the trigger spring 5 and both the axis and the line extend at an angle α to the horizontal as shown in a force diagram D.

Figure 2:
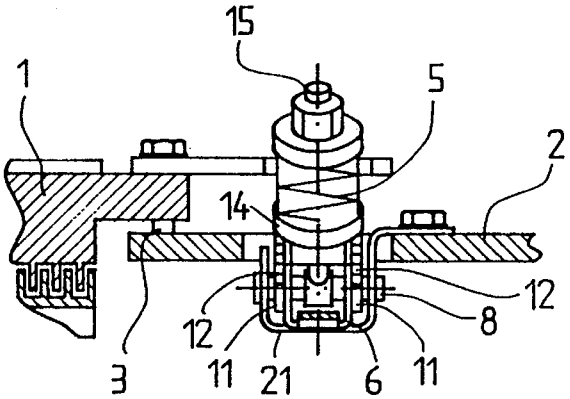
FIG. 2 is fragmentary rear elevation view of a safety switch actuator of the apparatus shown in the FIG. 1.

In the FIG. 2, both of the legs 11 with the detent notches 12 are shown with the spring pin 15 extending therebetween. The axle pin 8 is supported in a retaining bracket 21 attached to the carrier plate 2. The trigger spring 5 is coupled to the comb plate 1 by engagement of the detent pins 13 with the detent notches 12.

Figure 3:
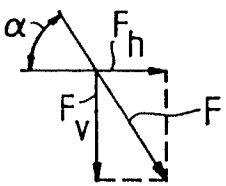
FIG. 3 is a force diagram of forces applied to the safety switch actuator shown in the FIGS. 1 and 2.

The FIG. 3 is an enlarged view of the force diagram D shown in the FIG. 1. A force vector F extends at the angle of and is a resultant static force acting along a line of action corresponding to the longitudinal axis L of the trigger spring 5 and the pin 15. The force F represents the bias of the trigger spring 5 set by means of the adjusting nut 19. In the position shown in the FIG. 1, the angle α of the line of action of the spring 5 is determined by the position of the detent pin 13 retained in a selected one of the detent notches 12.

The upper pressure washer 18 is urged against an upper end of the trigger spring 5 by means of the adjusting nut 19 and the static force F is set by tightening or loosening the nut. The force F, acting at the angle α, urges the lower edges of the legs 11 into abutment against the axle pin 8. When a force, which is greater than the resultant force F, arises due to application of an external force on the comb plate 1, the legs 11 are pushed away from the axle pin 8 and the switching lever 6 is entrained by way of the entraining pin 16. The pin 16 causes counterclockwise rotation (as viewed in the FIG. 1) about the axle pin 8 which has the consequence of actuating the safety switch 10 by the longer switching arm **6*a* of the switching lever 6**.

The static force F can be resolved into a horizontal component $F_h$ and a vertical component F. In the set position of the trigger spring 5 shown in the FIG. 1, the angle α is about 60° relative to the horizontal. For this position of the trigger spring 5, it is evident upon a graphical evaluation of the force diagram D shown in the FIG. 3 that, for an actuation of the safety switch 10 in the horizontal direction, about half the magnitude of the force F, which corresponds to the horizontal component $F_h$, must be overcome through application of an horizontally directed force $F_{h-}$ to the comb plate 1 in a direction opposite the horizontal component $F_h$. For an actuation of the safety switch 10 in the vertical direction, a much greater force, almost 90% of the magnitude of the force F, which corresponds to the vertical component $F_v$, must be overcome by application of a vertically directed force $F_{v-}$ to the comb plate 1 in a direction opposite the vertical component $F_v$. The static ratio of the horizontal triggering force $F_h$ to the vertical triggering force $F_v$ is about 1:1.75 in the case of the shown angle α. When the angle α is set to, for example, 45° by resetting the trigger spring 5 through movement of the detent pins 13 along the detent notches 12, the ratio becomes logically $F_h:F_v=1:1$. For a setting angle of less than 45°, the ratio changes such that the magnitude of the force $F_h$ is greater than the magnitude of the force $F_v$. Expressed as trigonometric formula, the relationship is:

$$F=F_h/\cos\alpha$$

The resetting of the trigger spring 5 in small angular steps on the detent notches 12 makes any desired adaptation of the ration $F_h:F_v$ possible. Thus, without any requirement to modify the construction of the safety equipment, an immediate adaptation to changed external conditions or to changed regulations can take place at any time. With appropriate configuration of the detent notches 12 and/or the detent pins 13, a jerky or positive resetting from one detent notch to the next detent notch is possible without prior compression of the trigger spring 5, while a secure retention of the setting is equally well assured. The entraining pin 16 likewise can be adjusted. A nut 20 threadably engaging the pin 16 above the abutment 4 permits the initial position of the switching lever 6 to be set by an appropriate change in length. The spring 7 is biased against the underside of the abutment 4 by the nut 22. By means of this arrangement, the switching lever 6 is on the one hand constrainedly entrained upon a movement of the comb plate 1. On the other hand, the possibility thus results to actuate the switching lever 6 manually without moving the comb plate 1 for the purpose of testing and setting.

When the comb plate 1 is raised up by vertical forces $F_{v-}$, such as for example a wedge-shaped foreign body in a step groove, the comb plate can raise up to a height adjustable by the abutment screws 9. In that case, the comb plate 1 can pivot through a very small angle about a fulcrum point at the fulcrum slide pins 3. The fulcrum slide pins 3 for this purpose have half-spherical inserts at their end faces.

The safety equipment according to the present invention is not restricted in construction details to the example shown. The detenting of the trigger spring 5 in a certain position can also be executed by means of a fine toothing on the lower pressure washer 14 and on the circularly arcuate edges of the legs 11. A further adjusting construction would consist in cutting out a respective arcuate slot at the side of both of the legs 11 and to fix the spring pin 15 steplessly at any desired position by means of a respective transverse pin with thread and nut.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. An apparatus for stopping a people conveyor, the people conveyor having a comb plate for supporting people slidably mounted on a carrier plate for relative movement between the comb plate and the carrier plate in a generally horizontal direction and a generally vertical direction, comprising:

a trigger spring means having means for pivotally mounting on a people conveyor carrier plate for applying a trigger force to a comb plate for supporting people slidably mounted on the carrier plate for movement relative to the carrier plate in a generally horizontal direction and a generally vertical direction;

a trigger force magnitude adjusting means connected to said trigger spring means for selectively adjusting a magnitude of said trigger force;

an abutment means for attachment to the comb plate;

a trigger force component ratio adjustment means coupling said trigger spring means to said abutment means for selectively adjusting a ratio of an horizontal force component to a vertical force component of said trigger force; and a switching lever for pivotal mounting on the carrier plate and being connected to said abutment means whereby when said trigger spring means is pivotally mounted on the carrier plate, said abutment means is attached to the comb plate and said switching lever is positioned adjacent a safety switch mounted on the carrier plate for controlling movement of the people conveyor and a force is applied to the comb plate which applied force overcomes at least one of said vertical component and said horizontal component of said trigger force, the comb plate moves relative to the carrier plate to rotate said switching lever into actuating contact with the safety switch to actuate the safety switch for stopping the people conveyor.

2. The apparatus according to claim 1 wherein said trigger spring means includes a spring pin extending through a trigger spring and said means for pivotally mounting includes one end of said spring pin pivotally mounted on an axle pin for attachment to the carrier plate.

3. The apparatus according to claim 2 wherein said trigger force magnitude adjusting means includes an adjusting nut threadably engaging another end of said spring pin and abutting said trigger spring for selectively adjusting a length of said trigger spring.

4. The apparatus according to claim 1 wherein said trigger force component ratio adjustment means includes a plurality of detent notches formed in said abutment means and a detent pin connected to said trigger spring means for selectively releasably engaging said detent notches to change an angle at which said trigger force is applied to the comb plate relative to an horizontal plane.

5. The apparatus according to claim 1 wherein said switching lever has a switching arm extending from a pivot point of said switching lever to a free end for non-actuating contact with the safety switch and a shorter arm extending from said pivot point to a free end connected to said abutment means.

6. The apparatus according to claim 5 including means for rotating said switching lever out of actuating contact with the safety switch when the applied force is removed from the comb plate.

7. The apparatus according to claim 6 wherein said means for rotating includes an entraining pin having one end pivotally mounted at said free end of said shorter arm of said switching lever and another end extending through an aperture in said abutment means, said entraining pin extending through a compression spring, and an adjusting nut threadably engaging said entraining pin and abutting said compression spring for selectively adjusting a length of said compression spring.

8. An apparatus for stopping a people conveyor comprising:

a trigger spring mounted on a spring pin for applying a trigger force to a comb plate for supporting people slidably mounted on a people conveyor carrier plate for movement relative to the carrier plate in a generally horizontal direction and a generally vertical direction, said spring pin having at one end thereof means for pivotally mounting on a people conveyor carrier plate;

a trigger force magnitude adjusting means mounted on said spring pin and abutting said trigger spring for selectively adjusting a magnitude of said trigger force;

an abutment for attachment to the comb plate;

a trigger force component ratio adjustment means coupling said trigger spring to said abutment for selectively adjusting a ratio of an horizontal force component to a vertical force component of said trigger force; and a switching lever for pivotal mounting on the carrier plate and being connected to said abutment whereby when said trigger pin is pivotally mounted on the carrier plate, said abutment is attached to the comb plate, said switching lever is positioned adjacent a safety switch mounted on the carrier plate for controlling movement of the people conveyor and a force is applied to the comb plate which applied force overcomes at least one of said vertical component and said horizontal component of said trigger force, the comb plate moves relative to the carrier plate to rotate said switching lever into actuating contact with the safety switch to actuate the safety switch for stopping the people conveyor.

9. The apparatus according to claim 8 wherein said trigger force magnitude adjusting means includes an adjusting nut threadably engaging another end of said spring pin and abutting said trigger spring for selectively adjusting a length of said trigger spring.

10. The apparatus according to claim 8 wherein said abutment has a pair of legs positioned on opposite sides of said spring pin and said trigger force component ratio adjustment means includes a plurality of detent notches formed in an edge of each of said legs and a pair of detent pins connected to said trigger spring means for selectively releasably engaging said detent notches in associated ones of said legs to change an angle at which said trigger force is applied to the comb plate relative to an horizontal plane.

11. The apparatus according to claim 8 including means for rotating said switching lever out of actuating contact with said safety switch when the applied force is removed from said comb plate, said means for rotating being connected between said abutment and said switching lever.

12. A people carrier comprising:

a people conveyor carrier plate;

a comb plate for supporting people slidably mounted on said carrier plate for movement relative to said carrier plate in a generally horizontal direction and a generally vertical direction;

a safety switch mounted on said carrier plate for controlling movement of the people conveyor, said safety switch being actuated in response to forces applied to said comb plate;

a trigger spring means pivotally mounted on said carrier plate for applying a trigger force to said comb plate;

a trigger force magnitude adjusting means connected to said trigger spring means for selectively adjusting a magnitude of said trigger force;

an abutment means attached to said comb plate;

a trigger force component ratio adjustment means coupling said trigger spring means to said abutment means for selectively adjusting a ratio of an horizontal force component to a vertical force component of said trigger force; and a switching lever pivotally mounted on said carrier plate and being connected to said abutment means whereby when a force is applied to said comb plate which applied force overcomes at least one of said vertical component and said horizontal component of said trigger force, said comb plate moves relative to said carrier plate to rotate said switching lever into actuating contact with said safety switch to actuate said safety switch for stopping the people conveyor.

13. The apparatus according to claim 12 wherein said trigger spring means includes a spring pin extending through a trigger spring and having one end pivotally mounted on said carrier plate and said trigger force magnitude adjusting means includes an adjusting nut threadably engaging another end of said spring pin and abutting said trigger spring for selectively adjusting a length of said trigger spring.

14. The apparatus according to claim 12 wherein said trigger force component ratio adjustment means includes a plurality of detent notches formed in said abutment means and a detent pin connected to said trigger spring means for selectively releasably engaging said detent notches to change an angle at which said trigger force is applied to said comb plate relative to an horizontal plane.

15. The apparatus according to claim 12 wherein when the applied force overcomes said vertical component, said comb plate pivots on said carrier plate to rotate said switching lever into actuating contact with said safety switch to actuate said safety switch for stopping the people conveyor.

16. The apparatus according to claim 12 wherein when the applied force overcomes said horizontal component, said comb plate slides on said carrier plate to rotate said switching lever into actuating contact with said safety switch to actuate said safety switch for stopping the people conveyor.

17. The apparatus according to claim 12 wherein said switching lever has a switching arm extending from a pivot point of said switching lever to a free end in non-actuating contact with said safety switch and a shorter arm extending from said pivot point to a free end connected to said abutment means.

18. The apparatus according to claim 17 including means for rotating said switching lever out of actuating contact with said safety switch when the applied force is removed from said comb plate, said means for rotating being connected between said abutment means and said switching means.

19. The apparatus according to claim 18 wherein said means for rotating includes an entraining pin having one end pivotally mounted at said free end of said shorter arm of said switching lever and another end extending through an aperture in said abutment means, said entraining pin extending through a compression spring, and an adjusting nut threadably engaging said entraining pin and abutting said compression spring for selectively adjusting a length of said compression spring.

20. The apparatus according to claim 12 including at least one from slide pin and one rear fulcrum slide pin positioned between said comb plate and said carrier plate permitting sliding movement of said comb plate relative to said carrier plate in a generally horizontal direction, said rear fulcrum slide pin permitting pivoting movement of said comb plate in a vertical direction.

* * * * *